United States Patent [19]

Kalbac

[11] 4,437,814

[45] Mar. 20, 1984

[54] DREDGE PUMP DRIVE SYSTEM

[75] Inventor: John F. Kalbac, St. Louis, Mo.

[73] Assignee: Delta Dredge and Pump Corporation, St. Louis, Mo.

[21] Appl. No.: 283,488

[22] Filed: Jul. 15, 1981

[51] Int. Cl.[3] ..... F04B 17/00

[52] U.S. Cl. ..... 417/351; 417/363

[58] Field of Search ..... 417/360, 351, 61, 363, 417/406, 407, 423; 210/242.1; 37/58, 59, 60, 61

[56] References Cited

U.S. PATENT DOCUMENTS

| | | | |
|---|---|---|---|
| 2,073,404 | 3/1937 | Hobbs | 417/351 |
| 2,800,272 | 7/1957 | McKee | 417/363 |
| 3,578,279 | 5/1971 | Scheldorf | 417/363 |
| 3,698,833 | 10/1972 | Cann et al. | 417/363 |
| 3,926,537 | 12/1975 | Piper | 417/360 |

*Primary Examiner*—Carlton R. Croyle
*Assistant Examiner*—Jeffrey A. Simenauer
*Attorney, Agent, or Firm*—Polster, Polster and Lucchesi

[57] ABSTRACT

In a dredge pump having a pump housing and an impeller in the housing, an impeller shaft projects through and beyond the housing in both directions. Two drive motors, one coupled rigidly to one end of the shaft and the other, to the other end, to drive the shaft, hence the impeller, are mounted on supports. The supports are mounted on pads made up of a pair of plates with an elastomeric block sandwiched between and bonded to them, by being connected to one of the plates of each pad. The other of the pad plates is mounted or secured to a fixed structure located with respect to the pads and impeller so that axial forces from the impeller shaft tending to put one set of pads in tension are countered by axial forces tending to put the other set of pads in compression. The pads permit substantial torsional movement, and provide compensation for slight misalignment of the drive motors, permitting the rigid coupling of the drive motors to the two ends of the impeller shaft.

4 Claims, 3 Drawing Figures

DREDGE PUMP DRIVE SYSTEM

BACKGROUND OF THE INVENTION

In a dredge pump it would be desirable to be able to couple a drive motor directly and rigidly to the impeller. However, it has been common practice heretofore to use flexible couplings to provide for misalignment, and to drive the impeller from one side. The term drive motor is used herein to indicate a drive unit, which may include a gear reducer the output shaft of which is what is coupled to the impeller shaft.

One of the objects of this invention is to provide a simple, rugged, dependable, effective drive system and mount therefor, which permits drive motors to be directly coupled to opposite ends of a shaft of the impeller of a dredge pump.

Other objects will become apparent to those skilled in the art in the light of the following description and accompanying drawing.

SUMMARY OF THE INVENTION

In accordance with this invention, generally stated, in a dredge pump having a pump housing and an impeller in the housing, an impeller shaft projects through bearings carried by the housing and beyond the housing in both directions. Two drive motors, one rigidly coupled to one end of the shaft and the other, to the other end, to drive the shaft, hence the impeller, are mounted on supports, which are preferably three arms projecting from each motor to a position roughly 120 degrees apart. The supports are mounted on sandwich mounts, pads made up of a pair of plates with an elastomeric block sandwiched between and bonded to them, by being bolted or otherwise mounted or secured to one of the plates of each pad. The other of the plates is mounted or secured to a fixed structure preferably located between the supports and the impeller. The fixed structure can be and preferably is part of or fixed to the pump housing itself. In any event, the pads are mounted between the motor supports and the fixed structure in such a way that axial movement of the shaft tends to put the elastomeric block of one set of pads in compression, and limits the amount of tension to which the elastomeric blocks of the other set of pads is subjected. The pads have great strength and little deformation in compression and substantial resilience and great strength in shear or torsion.

DESCRIPTION OF THE PREFERRED EMBODIMENT

Figure 1:
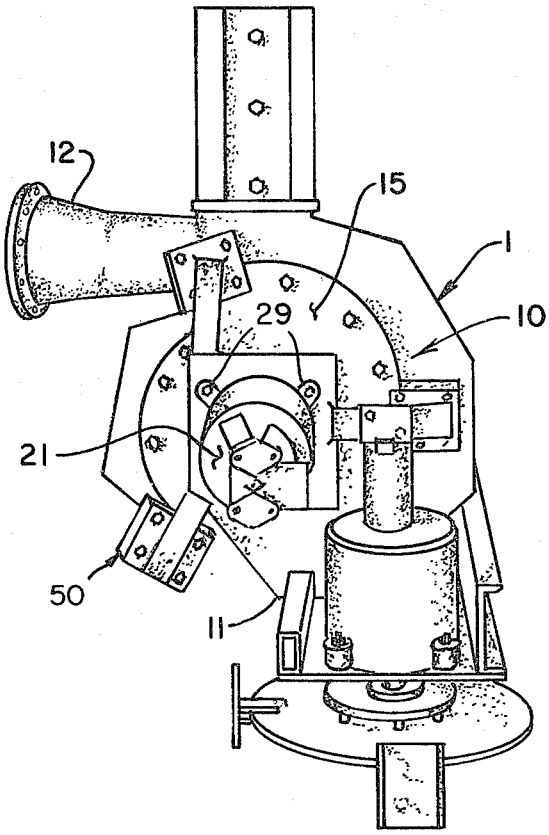
FIG. 1 is a view in perspective of one embodiment of dredge pump drive system of this invention.

Referring now to the drawing for one illustrative embodiment of this invention, reference numeral 1 indicates a dredge pump mounted above and between disc cutters 2 driven by hydraulic motors 3.

The pump has a housing 10, with an inlet indicated at 11, an outlet or discharge 12 and side walls 15. An impeller within the housing is supported on a shaft journalled in bearings carried by the housing side walls. The ends of the shaft project through and beyond the side walls 15 of the housing on both sides. Hydraulic drive motors (which, as has been indicated above, include gear reducers) 20 and 21 are connected directly and rigidly to the ends of the shaft. In the illustrative embodiment shown, the motors 20 and 21 are each of 200 hp, supplied with hydraulic fluid under pressure by a 500 hp electric motor driving a hydraulic pump on the dredge, which also supplies hydraulic fluid to the motors 3.

Figure 2:
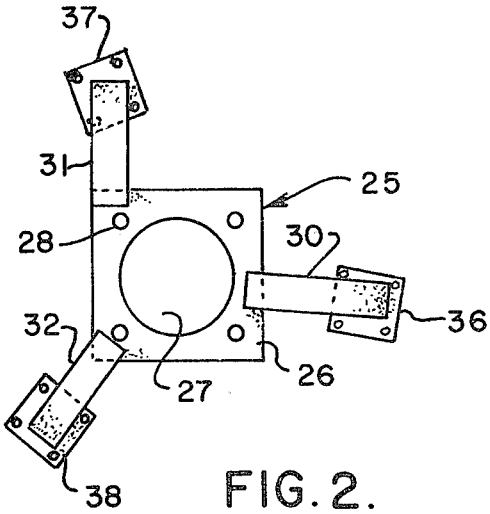
FIG. 2 is a view in side elevation of a motor mount as shown in FIG. 1, with the drive motor removed.

Each of the drive motors 20 and 21 is mounted on a support 25, which in this embodiment includes a base 26 in the form of a square plate with a central shaft-receiving opening 27 and bolt holes 28 that align with holes in ears 29 integral with the housing of the drive motors 20 and 21, and three arms 30, 31 and 32. The arms 30, 31 and 32 are heavy channels, welded at one end to the base 26 and at their other ends to mounting plates 36, 37 and 38, respectively. The arms project at an obtuse angle from the plane of the base 26, and are so spaced about the base 26 that the mounting plates 36, 37 and 38 are located approximately 120 degrees from one another with respect to the axis of rotation of the shaft, as viewed in FIG. 2. The mounting plates are substantially parallel to the base plate 26, and lie in substantially the same plane with one another.

The support 25 upon which the motor 20 is mounted is a mirror image of the support 25 upon which the motor 21 is mounted.

Mounting flats 45 are provided on the housing 10, as by welding the legs of channels to the housing, in positions complementary to and parallel with the mounting plates 36, 37 and 38. A pad 50, with an outer plate 51, an inner plate 52, and a block 53 of elastomeric material bonded to and sandwiched between plates 51 and 52, connects each of the plates 36, 37 and 38 to a flat 45. The plate 51 of the pad is bolted to the mounting plate 36, 37 or 38, and the plate 52, to a flat 45.

Figure 3:
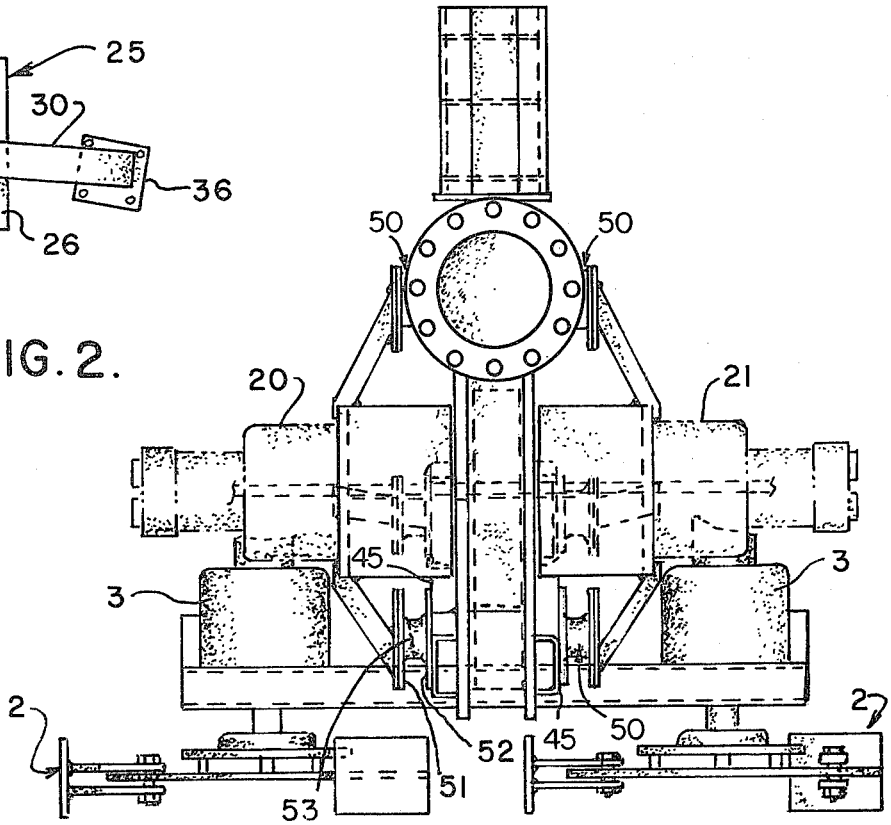
FIG. 3 is a view in front elevation of the device shown in FIG. 1.

The flats 45 on opposite sides of the housing are substantially aligned across the housing, as indicated in FIG. 3. Any tendency of the motor shaft to move axially will therefore result in the elastomeric block of the pads on one side's being subjected to compressive forces immediately opposite the elastomeric blocks of the pads on the other side, which will limit the amount of tension to which the latter blocks will be subjected. The blocks have great strength but little deformation in compression and substantial resilience and great strength in shear or torsion. This arrangement, therefore, permits the motors to be coupled rigidly to the ends of the shaft but at the same time to accommodate for misalignment and shock.

Merely by way of illustration, with the hydraulic motors described driving a twenty-six inch impeller on a three inch shaft, pads with a six inch diameter block of rubber or other suitable elastomeric material two and a half inches thick have been found satisfactory.

Suitable pads, sometimes called sandwich mounts, may be obtained commercially, as, for example, from Lord Kinematics of Erie, Pa.

Numerous variations in the construction of the device of this invention within the scope of the appended claims will occur to those skilled in the art in the light of the foregoing disclosure. By way of illustration, the mounting arms can be increased or decreased in number, or assume other configurations. Massive separate structures can be used to support the motor mount on each side, both being either inboard or outboard of the motor mount supports, so long as the structures and pads are arranged to place one set of pads in compression when the other is subjected to tension, thus effectively to inhibit excessive movement of the pads in a direction away from the impeller. However, the three-point suspension and the provision of flats directly on the housing offer advantages in economy and effectiveness over these particular variations.

I claim:

1. In a dredge pump having a pump housing and an impeller within said housing, the improvement comprising a shaft upon which said impeller is mounted, said shaft projecting through and beyond said housing on both sides of said impeller; two drive motors outside said housing, one rigidly coupled to one end of said shaft and the other, to the other end of said shaft, to drive said shaft, hence said impeller, and mounting means for mounting said drive motors, said mounting means comprising angularly spaced supports to which said drive motors are connected, pads, each including an elastomeric block bonded to and sandwiched between inner and outer flat plates, one of each of said plates being connected to one of said supports, the flat plates on the supports of each of the motors lying in substantially a common plane and the said plates on the supports of the two motors lying in substantially parallel planes, fixed structures on opposite sides of said pump housing, each having mounting flats spaced and arranged complementarily to pads on its respective side of the pump housing, the other of said plates of each pad being connected to a flat of one of said structures, the pad plates closest to the housing on opposite sides of the pump housing facing one another, whereby in response to axial movement of the impeller shaft, hence the motors, one set of pads is in compression, the other, in tension and in response to turning moment of said motors, both sets are in shear.

2. The improvement of claim 1 wherein the supports of each of the drive motors comprise arms projecting at an obtuse angle toward the housing, said pads being connected to said arms.

3. The improvement of claim 1 wherein the fixed structures to which the pads are mounted are on the housing itself.

4. The improvement of claim 1 wherein the supports of each of the drive motors comprise arms terminating in mounting plates with flat surfaces lying in substantially a common plane, said mounting plates being located substantially 120 degrees apart with respect to the axis of rotation of the shaft, said pads being connected to said mounting plates.

* * * * *